US009522557B2

(12) United States Patent
Faber

(10) Patent No.: US 9,522,557 B2
(45) Date of Patent: Dec. 20, 2016

(54) ELECTRONIC PRINTING DEVICE IN THE FORM OF A MANUAL STAMP

(71) Applicant: COLOP Stempelerzeugung Skopek Gesellschaft m.b.H. & Co. KG., Wels (AT)

(72) Inventor: Ernst Faber, Wels (AT)

(73) Assignee: Colop Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 5 days.

(21) Appl. No.: 14/408,355

(22) PCT Filed: Jun. 25, 2013

(86) PCT No.: PCT/AT2013/050126
§ 371 (c)(1),
(2) Date: Dec. 16, 2014

(87) PCT Pub. No.: WO2014/000010
PCT Pub. Date: Jan. 3, 2014

(65) Prior Publication Data

US 2015/0144015 A1 May 28, 2015

(30) Foreign Application Priority Data

Jun. 27, 2012 (AT) ..... A 50252/2012

(51) Int. Cl.
*B41K 1/42* (2006.01)
*B41K 1/36* (2006.01)
(Continued)

(52) U.S. Cl.
CPC ..... *B41K 1/36* (2013.01); *B41J 2/16508* (2013.01); *B41J 2/16547* (2013.01); *B41J 3/36* (2013.01)

(58) Field of Classification Search
CPC ..... B41J 3/36; B41J 3/39; B41K 1/54; B41K 1/006; B41K 1/00; B41K 1/08
See application file for complete search history.

(56) References Cited

U.S. PATENT DOCUMENTS 6,109,726 A 8/2000 Lee
6,315,386 B1 * 11/2001 Bailey ..... B41J 2/16547 347/22
(Continued)

FOREIGN PATENT DOCUMENTS

CN 101626897 A 1/2010
DE 10 2010 000 074 A1 7/2011
(Continued)

OTHER PUBLICATIONS

International Search Report of PCT/AT2013/050126, mailed Oct. 14, 2013.
(Continued)

*Primary Examiner* — Matthew G Marini
(74) *Attorney, Agent, or Firm* — Collard & Roe, P.C.

(57) ABSTRACT

An electronic printing device in the form of a manual stamp has a housing in which an electronic printing unit cartridge is received to which an electronic control unit is assigned for setting the printed image and of which the lower printing head is disposed in order to generate a printed image via the open lower side of the housing on a base via which the housing is displaced, a slide cover being provided that is arranged so as to be displaceable between a closing or rest position in which it covers the lower printing head of the cartridge, and an open or printing position in which the lower printing head of the cartridge is exposed; the slide cover is displaceably arranged immediately on the lower side of the housing, the slide cover being guided in control
(Continued)

links which are provided on the sides of the housing and into which the slide cover engages via guide pins.

11 Claims, 4 Drawing Sheets

(51) Int. Cl.
*B41J 2/165* (2006.01)
*B41J 3/36* (2006.01)

(56) References Cited

U.S. PATENT DOCUMENTS

| | | | | |
|---|---|---|---|---|
| 6,991,332 | B1 | 1/2006 | Fan et al. | |
| 7,997,683 | B2 | 8/2011 | Mealy et al. | |
| 8,128,192 | B1 | 3/2012 | Simmons | |
| 2008/0204507 | A1 | 8/2008 | Michael et al. | |
| 2008/0316290 | A1* | 12/2008 | Brown | B41J 3/36 347/109 |

FOREIGN PATENT DOCUMENTS

| | | | | |
|---|---|---|---|---|
| EP | 1 439 066 | A1 | | 7/2004 |
| EP | 2 192 556 | A1 | | 6/2010 |
| JP | 05253685 | A | * | 10/1993 |
| JP | H05253685 | A | | 10/1993 |
| WO | 97/17206 | A | | 5/1997 |

OTHER PUBLICATIONS

Austrian Office Action in A 20252/2012, dated Nov. 26, with English translation of relevant parts.
Chinese Office Action in CN 201380039798.4, dated Sep. 25, 2015.

* cited by examiner

IV
VII
IX
x
y

X
XII
1
2
3
3'
4
5
6
7
8
10
13
14
15
16
17
18
19
20
21
22
23
24
33
34
35
36
3 (20)
40
41

ELECTRONIC PRINTING DEVICE IN THE FORM OF A MANUAL STAMP

CROSS REFERENCE TO RELATED APPLICATIONS

This application is the National Stage of PCT/AT2013/050126 filed on Jun. 25, 2013, which claims priority under 35 U.S.C. §119 of Austrian Application No. A 50252/2012 filed on Jun. 27, 2012, the disclosure of which is incorporated by reference. The international application under PCT article 21(2) was not published in English.

The invention relates to an electronic printing device in the form of a hand stamp, comprising a housing in which an electronic printing unit cartridge is received, which is associated with an electronic control unit for setting a print image and whose lower printing head is arranged to generate a print image through the open housing bottom side on a document over which the housing is moved, wherein there is provided a slide cover which is disposed to be displaceable between a closing or rest position, in which it covers the lower printing head of the cartridge, and an open or printing position, in which the lower printing head of the cartridge is exposed.

Hand stamps, in particular self-inking hand stamps, have frequently proved to be successful in the past. In more recent times, common hand stamps have, however, experienced a developposed to connect the electronic hand stamp to a computer or a digital camera etc. in order to generate images (i.a. also text images, if desired) and subsequently load the latter into a memory of the electronic stamp, cf. e.g. U.S. Pat. No. 6,991,332 B1. Those electronic hand stamps and other comparable digital hand stamps comprise a printing head displaceably guided in a frame for printing the respective image on a given substrate surface—with the stamp housing held stationary. This will, however, involve relatively complex movement control for the printing head. ment towards electronic or digital hand printing devices, such electronic printing devices enabling the generation of variable print images, in particular including reproductions of photos, in addition to text images. In this context, it was also pro On the other hand, electronic or digital hand stamps in which the printing head is stationarily arranged in the housing also have already become known; WO 97/17206 A, for instance, discloses electronic hand stamp embodiments comprising movable printing heads and, alternatively, ones comprising printing heads stationarily arranged in housings. In the case of a fixed printing head, where the stamp is stationarily held on the substrate surface or document to be printed, the print image will, of course, depend on the size of the opening provided on the bottom side of the stamp housing. In this respect, however, it was also already proposed to move the electronic hand stamp during the printing procedure over the document in order to enable the printing of larger print images, as compared to the printing part proper of the printing head, on the document. In this case, the printing head may also only occupy a part of the surface of the opening provided on the bottom side of the electronic hand stamp.

Such electronic hand stamps, as a rule, use ink jet printers, which are controlled in a conventional manner by an electronic control unit in order to set, and print, the respective print image retrieved from a memory. The technology used therefor essentially corresponds to that applied in conventional desk ink jet printers, where the desired, large print images (including texts) are generated on a larger surface as compared to the printing head proper, and wherein a relative movement takes place between the printing head and the printing surface (paper). In the case of electronic hand stamp printing devices, the document, e.g. a sheet of paper, an envelope etc., lies on a desk or the like, and the printing procedure is performed using the electronic hand stamp in the above-described manner by placing the stamp on the document and optionally moving the hand stamp over said document. In doing so, a fixed distance of, for instance 3 mm, usually is to be observed between the printing head and the document, said distance being relatively small. At the same time, the printing head, with its bottom-side nozzles, is relatively prone and sensitive to mechanical influences, contamination and damage, the aforementioned distance even increasing the problem of a possible contamination of, and mechanical damage to, the printing head.

It is known from hand stamps, e.g. self-inking stamps, to fit a plastic cap over the open bottom side of the stamp housing when the stamp is not in use, and to remove said cap when the stamp is used. That separate cap is, however, relatively cumbersome to handle, and in practice this will frequently prevent the cap from being put back after the use of a stamp.

From US 2008/0204507 A1, an electronic hand stamp as described above is known, which is additionally equipped with a "service station" in the form of a cap; in the assembled state, that cap is located in the region of the ink jet printer of the hand stamp, thus normally covering the nozzle openings of the former. When the hand stamp is to be utilized, a shutter provided on said cap in the region of an opening is displaced to expose the nozzle openings. This displacement movement takes place in parallel with the plane of the nozzle openings, wherein the guide for the shutter and the position of the shutter in its release position will result in a relatively large distance between the nozzle openings and the substrate to be printed. In addition, the solution with a complex cap is cumbersome and expensive.

The invention tries to provide a remedy for this problem by proposing an electronic printing device in the form of a hand stamp, in the following also briefly referred to as "electronic hand stamp", with a simple arrangement of the slide cover while achieving adequate protection for the printing head and a small distance to the substrate; as mentioned before, the printing head of the electronic hand stamp can also be smaller than the surface area of the bottom side of the stamp housing, and the electronic hand stamp can be manually moved over the document to be printed during the printing operation.

To solve the above-mentioned object, the invention accordingly provides an electronic printing device of the initially defined kind, which is characterized in that the slide cover is directly disposed on the housing bottom side in a displaceable manner, said slide cover being guided in control slots laterally provided on the housing and in which it engages by guide pins.

In the present electronic printing device or electronic hand stamp, the slide cover is directly attached to the housing bottom side; the slide cover is at least substantially captively arranged on the housing and may be smaller than the surface area of the bottom side of the housing. Said slide cover is normally held in a closing position in which the printing device is out of operation and in which it covers and protects the printing head; when the electronic hand stamp is to be utilized, the slide cover can, however, be displaced out of said closing position into an open position in which the printing head is exposed to make the desired print on a document.

The slide cover at least in its two end positions (closing position, open position) is not to project beyond the housing bottom side in order to enable the electronic hand stamp to be placed on a document in either position. On the other hand, the displacement movement of the slide cover is to compromise neither any electronic parts of the hand stamp on the bottom side nor, in particular, the printing head and its nozzles. The slide cover is, therefore, guided in control slots laterally provided on the housing and in which it engages by guide pins.

In this context, it will be particularly advantageous if the control slots comprise downwardly and upwardly oriented portions, wherein the slide cover, at least by a front edge region extending transversely to the displacement direction and facing away from the open position, is guidable initially downwardly and in the direction towards the open position, and ultimately again upwardly into the final open position, during its displacement out of the closing position. Therein, it will be of particular advantage if two consecutively arranged control slots are provided on each housing side, one of which, i.e. the rear control slot, which is located in the region of the open position, extends straightly and in parallel with the housing bottom side, whereas the other, front control slot, i.e. that located in the region of the closing position, comprises two higher-level end portions adjoining the ends of a lower-level central portion via inclined portions.

In order to provide a special protection for the printing head, it has, moreover, proved to be beneficial if the slide cover comprises its own printing-head cover insert, which is preferably made of a softer material than the remaining slide cover. Here, the cover insert may simply have the shape of a flat cap or tub. In the closing position, said cap or tub receives the printing head.

Where the printing head is configured as an ink jet printer, it will, on the other hand, also be beneficial if the slide cover comprises a separate wiper lip insert for wiping the printing head during the displacement of the slide cover into the open position. This wiper lip insert is preferably also made of a comparatively soft material, and, during the displacement of the slide cover, it is preferably deflectable out of a vertical rest position by abutment on the printing head. According to a particularly preferred embodiment, it is further provided that the wiper lip insert comprises an exemption on its freely cantilevering upper side, i.e. on the front edge facing away from the open position, wherein the printing or nozzle part proper of the printing head remains uncleaned during the displacement of the slide cover into the closing position in order to avoid drying-up.

In order to enable simple manufacture, it is furthermore beneficial if the wiper lip insert is made of the same material as the printing-head cover insert.

For the simple handling of the electronic hand stamp, it may, moreover, be provided that the slide, cover activates a printing-head main switch or switch-on means in the open position.

When producing a print that is larger than the printing head, or by displacing the electronic hand stamp over the document to be printed, it is furthermore known to provide position sensors on the bottom-side of the electronic hand stamp in order to detect the respective position or movement of the electronic hand stamp. In this case, it is, moreover, advantageous if the slide cover comprises thoroughgoing openings for the passage of radiation of position sensors, e.g. laser sensors. It will also be beneficial if the slide cover comprises cover tabs covering the position sensors, e.g. laser sensors, in its closing position.

In the following, the invention will be explained in more detail by way of preferred exemplary embodiments, to which it is, however, not to be restricted, and with reference to the drawing. In the drawing.

Figures 1, 2, 4, 5, 6, 7, 8, 9, 10:
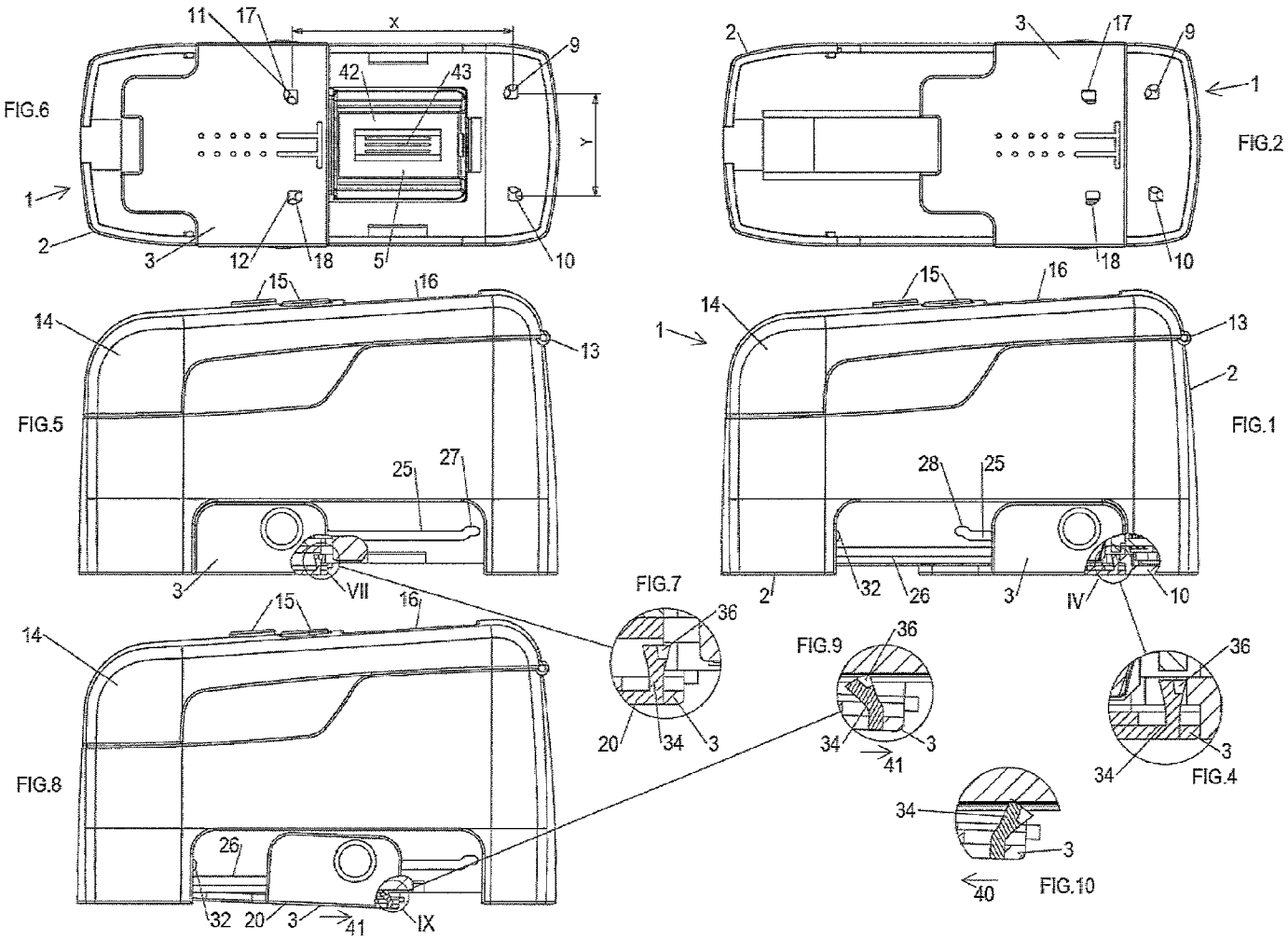
FIG. 1 depicts a side view of an electronic printing device in the form of a hand stamp, in the following briefly called electronic hand stamp, in the closing or rest position, wherein a part of the electronic hand stamp is broken up to illustrate a detail IV.
FIG. 2 is a bottom view of the hand stamp in the closing position.
FIG. 4 illustrates the detail IV of FIG. 1 on an enlarged scale.
FIG. 5 is a side view of the electronic hand stamp of FIG. 1, yet in the open position or printing position.
FIG. 6 depicts said electronic hand stamp in the open position, in a bottom view similar to that of FIG. 2.
Figures 3, 11, 12, 13, 14, 15:
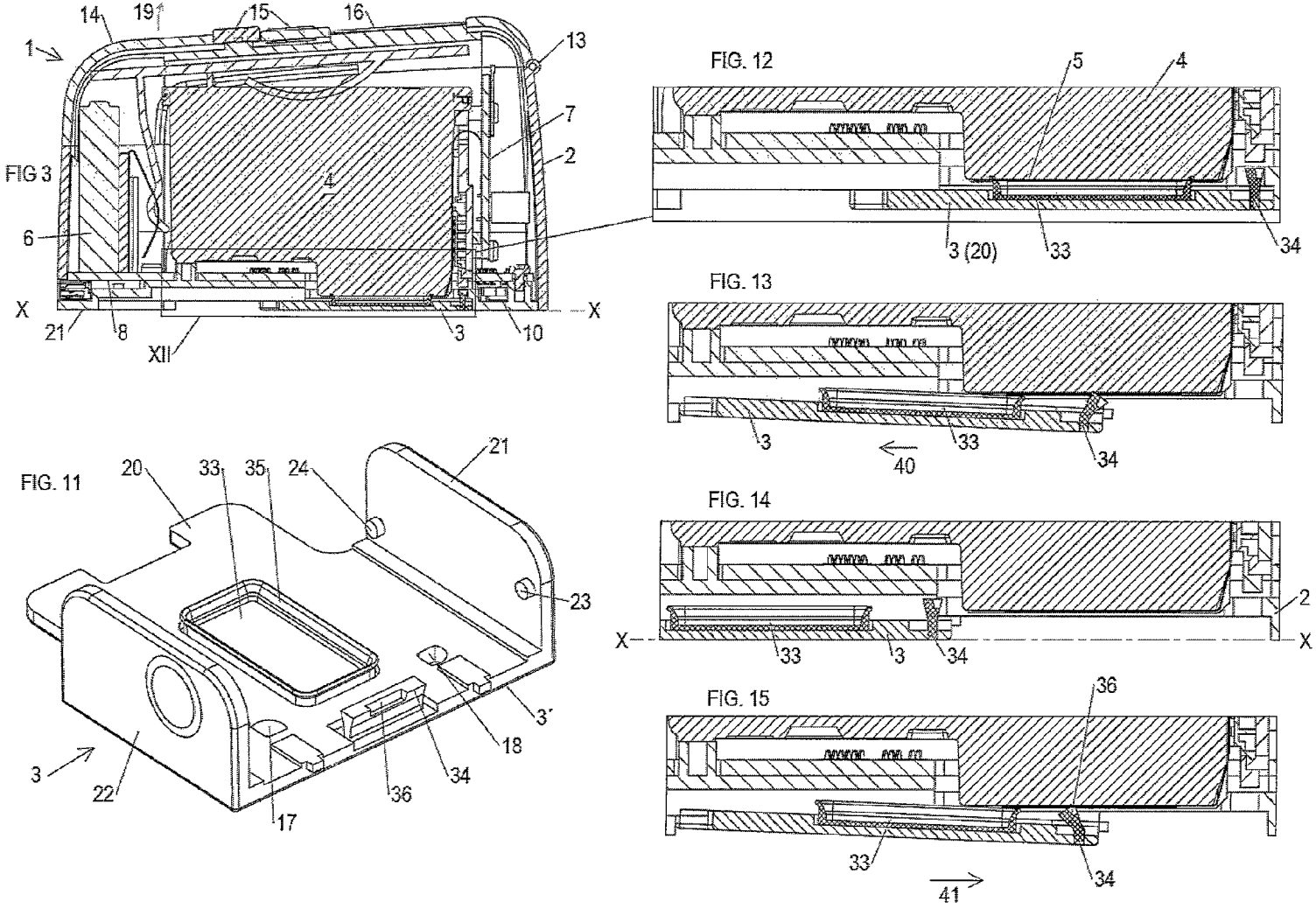
FIG. 3 is a longitudinal section through the hand stamp in the closing position.
Figure 16:
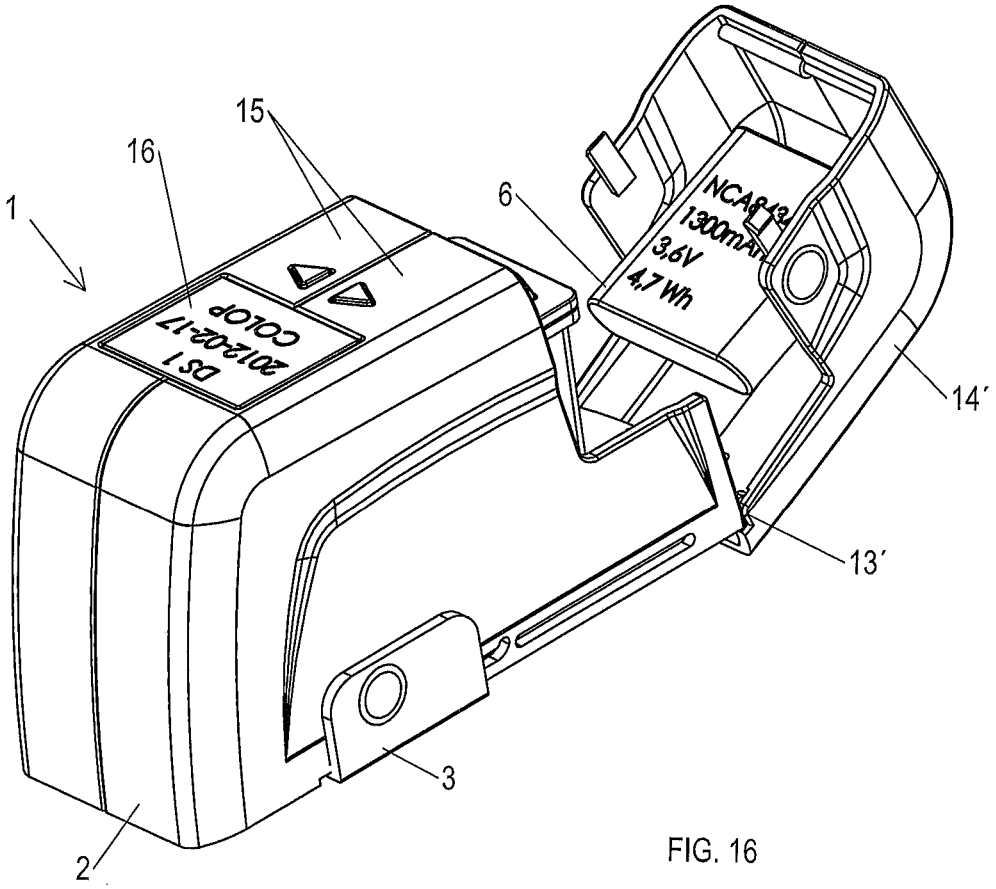
Figure 17A:
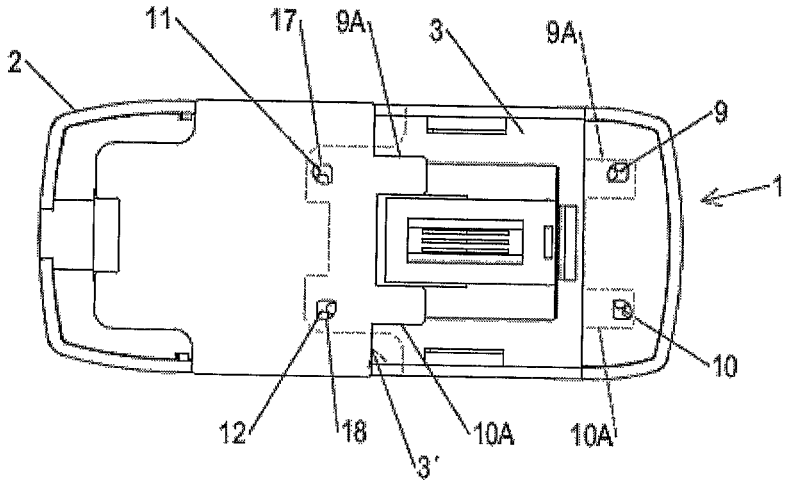
Figure 17B:
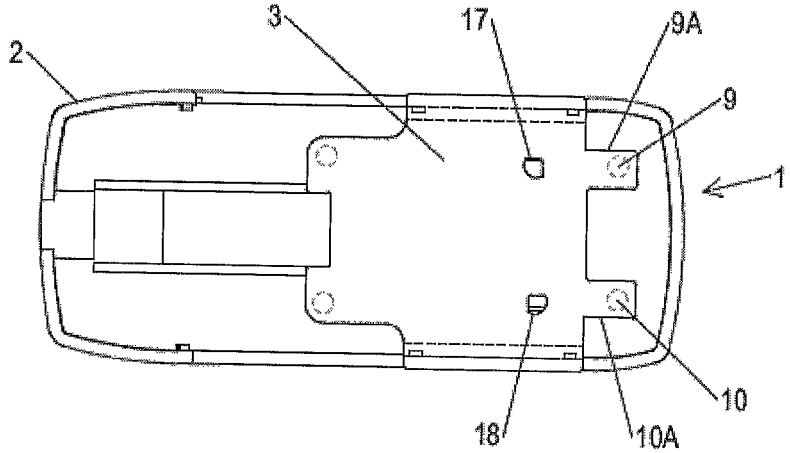

FIG. 7, on an enlarged scale, depicts the detail VII apparent from FIG. 5 by a partially broken-up illustration similar to FIG. 1;

FIG. 8 is a partially sectioned, rather schematic illustration of the electronic hand stamp according to FIGS. 1 to 7, wherein a slide cover apparent from FIGS. 1, 2, 3 as well as 5 and 6 is shown in an intermediate position and control slots for said slide cover are, moreover, indicated;

FIG. 9, on an enlarged scale, depicts the detail IX according to FIG. 8, i.e. with a wiper lip insert on the slide cover, illustrating the situation during a movement of the slide cover from the open position into the closing position;

FIG. 10 illustrates the detail according to FIG. 9, yet during a movement of the slide cover from the closing position into the open position;

FIG. 11 is a diagrammatic representation of a slide cover comprising a separate printing-head cover insert and wiper lip insert;

FIG. 12 depicts the detail XII from FIG. 3 on an enlarged scale, the slide cover being illustrated in the closing position; and FIGS. 13, 14 and 15 are illustrations similar to that of FIG. 12, the slide cover being respectively shown in an intermediate position during opening (FIG. 13), in the open position (FIG. 14), and in an intermediate position during closing (FIG. 15);

FIG. 16 illustrates an embodiment modified in respect to the articulation of a swing cover to the housing of the electronic hand stamp; and FIGS. 17A and 17B illustrate an embodiment comprising a modified slide cover in bottom views comparable to those of FIG. 6 and FIG. 2.

FIGS. 1, 2 and 3 respectively depict an electronic printing device 1, briefly electronic hand stamp 1, in side view, bottom view and longitudinal section, wherein a slide cover 3 attached to the bottom side 2' of the downwardly open housing 2 is provided in the closing or rest position. In this closing position of the slide cover 3, a printing unit cartridge 4 fixedly disposed in the interior of the housing 2, or to be more precise its printing head 5 (cf. also FIG. 6), is downwardly covered and hence protected from dirt and damage.

According to FIG. 3, besides others, a battery or accumulator 6, a printed circuit board 7 for controlling the cartridge 4, which also contains a memory and is to be referred to as electronic control unit 7, and a circuit board 8 for position sensors 9, 10, 11, 12 provided on the housing bottom side 2', cf., in particular, FIGS. 2 and 6 in addition to FIG. 3. Furthermore, a swing cover 14 is hinged to the housing 2, to the top side thereof, by the aid of an articulation 13; said swing cover 14, on its upper side, can be provided with operating switches 16 and optionally also with a display 15 to reproduce the respective print image, if desired.

As is, furthermore, apparent from FIGS. 2 and 6 as well as, in particular, also FIG. 11, the slide cover 3 comprises two openings 17, 18 in its right-hand front region 3' according to the illustration of the drawing, through which openings the position sensors 11, 12 are accessible in the open position (FIG. 6) in order to detect the respective position of the electronic hand stamp 1 in the open position, i.e. during the movement of the electronic hand stamp 1 over a document to be printed. The position sensors 9-10 and 11-12 comprise a distance Y in terms of width, and the position sensors 9-11 and 10-12 comprise a distance X in terms of length.

In FIG. 3, the opening direction of the swing cover 14 is, moreover, indicated by an arrow 19. When said swing cover 14 is swung out, i.e. opened, the battery 6 or the printer cartridge 14 can, for instance, be exchanged.

According to FIG. 11, the slide cover 3 comprises a base plate 20 and lateral cheeks 21, 22. To the lateral cheeks 21, 22 are formed, at different levels and distances from the base plate 20, inwardly located guide pins 23, 24 (from FIG. 11 only the guide pins 23, 24 provided on cheek 21 are apparent, the other cheek 22 comprising respective, mirror-imaged guide pins); by said guide pins, the slide cover 3 engages in control slots 25, 26 provided laterally inwardly in the housing 2, cf. in particular FIG. 8, yet also FIG. 1 and FIG. 5. The right-hand or front control slot 25 according to the illustration of the drawing (it goes without saying that such control slots 25 and 26 are provided on both longitudinal sides of the housing 2 in a mirror-image arrangement) comprises two higher-level end portions 27 (FIG. 5), 28 (FIG. 1) and a lower-level central portion 29 (FIG. 8) passing over into the end portions 27, 28 via inclined portions 30 (FIG. 8), 31 (FIG. 1), said end portions respectively defining the closing position (end portion 27) and the open position (end portion 28) of the slide cover 3. The other, lower-level control slots 26, which cooperate with the guide pins 24, are straight and horizontal control slots 26, wherein the left-hand, rear region of the slide cover 3 according to the illustration of FIG. 3 is moved forwards and backwards in an accordingly linear manner, as may also be taken, in particular, from FIGS. 12 to 15.

From FIG. 8, a (limit) switch 32 is, moreover, apparent, which forms a main switch or switch-on means for the digital or electronic hand stamp 1, and its printing head 5, and which is actuated when the slide cover 3 has reached its open position according to FIG. 5.

The slide cover 3 suitably is comprised of a comparatively hard plastic material such as ABS. To the base plate 20 of the slide cover 3 are, however, fastened two inserts made of a softer plastics material, i.e. a printing head cover insert 33 and a wiper lip insert 34. TPE with about 55 to 60 Shore A hardness may, for instance, be used as material for these inserts 33, 34. Although it is possible to use different materials for the inserts 33, 34, it is preferred to use one and the same material for these inserts 33, 34.

As is further apparent from FIG. 11, the printing-head cover insert 33 is configured as a flat cap or tub 35. The wiper lip insert 34, on its right-hand, front edge according to the illustration in the drawing, comprises an exemption 36 whose function will be explained in more detail below, in particular with reference to FIGS. 9 and 15.

The two inserts 33, 34 are anchored in the base plate 20 of the slide cover 3 via suitable holes, as is, in particular, apparent from FIG. 8 (yet cf. also FIGS. 2 and 6). In the closing position of the slide cover 3 according to FIGS. 1 to 3, yet also according to FIGS. 4 and 12, the slide cap 3 covers the printing head 5 of the cartridge 4 by the printing-head cover insert 33 so as to protect it from dirt or damage.

In this closing position of the slide cap 3, the latter is located in one plane X-X with the bottom edge of the housing, as is, in particular, apparent from FIG. 3.

The wiper lip insert 34, in the closing position, is in its neutral, vertical position, cf. FIG. 12 and FIG. 4.

If a print image is desired to be produced on a document (not illustrated) by the aid of the present electronic hand stamp 1, the slide cover 3 is moved rearwardly, or from the right to the left according to the illustration in the drawing, cf. arrows 40 in FIGS. 10 and 13. In doing so, the slide cover 3 at first moves slightly obliquely downwards according to the inclined portions 30 of the control slots 25 by its right front edge region and, after this, moves linearly backwards and to the left. In this manner, the printing-head cover insert 33 is downwardly lifted off the printing head 5 due to the above-described downward movement, yet the wiper lip insert 34 wipes over the nozzle region of the printing head 5 by its rear, left edge in the sense of scouring in order to clean the same. This is enabled by the wiper lip insert 34 being deflected or bent to the right, i.e. clockwise according to the illustration in the drawing, due to the friction on the printing head-bottom side, as is apparent from FIGS. 10 and 13.

In the rear, leftmost position of the slide cover 3, the front, right-hand edge region is again moved upwardly by the aid of the inclined portions 31 to transfer the pins 23 into the end position, i.e. into the end portions 28. The open position or printing position of the slide cover 3 as illustrated in FIGS. 5 and 7, and FIG. 14, has thus been reached. In the open position of the slide cover 3, the desired prints can be made on the respective document in a manner conventional per se using the cartridge 4 and the printing head 5.

After the printing procedure is completed, the slide cover 3 is again moved to the right, i.e. forwardly, according to the illustration in the drawing, into the closing position according to FIGS. 1, 3 and 12, wherein the wiper lip insert 34, during this movement according to arrows 41 in FIGS. 8 and 15, is deflected counter-clockwise, i.e. to the left, as is apparent from FIGS. 9 and 15. During this closing movement according to arrow 41 (cf. also FIG. 8), the right-hand edge region of the slide cover 3 is again initially moved downwardly according to the control of the guide pins 23 in the inclined portions 31 so as to move the slide cover 3, and the cover insert 33, past the bottom side of the printing head 5. However, the wiper lip insert 34 does not wipe off the printing head 5 of the cartridge 4 during this closing movement due to its exemption 36, but rather abuts the lateral boundaries or frame parts, e.g. 42 in FIG. 6, by its edge regions on both sides of the exemption 36 (cf. FIG. 11), yet while leaving free the printing unit 43 proper. Thus, no "wiping off" of the nozzles of the printing head 5, or the printing unit 43 proper will occur during such closing movement such that the small droplets will remain on the nozzles and dry up. These dried droplets will be wiped off during the subsequent printing process while opening the slide cover 3 according to FIGS. 10 and 13, as previously described.

At the end of the closing movement according to arrow 41, the closing position or rest position of the slide cover 3 illustrated in FIG. 12 is finally reached again.

FIG. 16 depicts an electronic hand stamp 1 slightly modified relative to that depicted in FIGS. 1 and 5 and 8, again including a displaceable slide cover 3 provided on the bottom side of the stamp housing, yet comprising a hinged or swing cover 14' that is articulated about a lower hinge 13' in the region of the bottom side 2' of the housing 2. The battery 6 may, for instance, be received in said hinged cover 14'. From FIG. 16, a top-side display 16—now provided on the top side of the housing 2 rather than on that of the cover 14—is moreover apparent, and actuation keys 15 are also illustrated in FIG. 16.

The control of the displacement movement of the slide cover 3 by the aid of control slots can be realized similarly as described before with reference to FIGS. 1 to 15.

FIGS. 17A and 17B illustrate an embodiment of the printing device 1 with a modified slide cover 3, which comprises two cover tabs or tongues 9A, 10A on its front side 3' (cf. FIG. 17A) which are functionless in the open position of the slide cover 3 depicted in FIG. 17A, yet cover the position sensors 9, 10 in the closing position depicted in FIG. 17B so as to provide protection from dirt or damage in this rest position.

The invention claimed is:

1. An electronic hand stamp comprising:

a housing having an open bottom side;

an electronic printing unit cartridge received in the housing and comprising a lower printing head;

an electronic control unit arranged for setting a print image; and a slide cover arranged to be displaceable between a rest position in which the slide cover covers the lower printing head at the open bottom side of the housing, and a printing position in which the lower printing head is exposed;

wherein the housing has opposed side walls which have respective control slots;

wherein the slide cover has a base plate and lateral side walls from which respective guide pins laterally project into the control slots of the housing side walls;

wherein the slide cover side walls are positioned at the outer side of the housing side walls, and the guide pins extend through the housing control slots towards the interior of the housing;

wherein two separate and consecutively arranged control slots are provided on each housing side, one of which, i.e. the rear control slot, which is located in the region of the printing position, extends straightly and in parallel with the housing bottom side, whereas the other, front control slot i.e. that is located in the region of the closing position, comprises two higher-level end portions adjoining the ends of a lower-level central portion via inclined portions; and wherein a respective one of the guide pins projects into a respective one of the control slots.

2. The printing device according to claim 1, wherein the control slots comprise downwardly and upwardly oriented portions, and wherein the slide cover, at least by a front edge region extending transversely to the displacement direction and facing away from the printing position, is guidable initially downwardly and in the direction towards the printing position, and ultimately again upwardly into a final printing position, during its displacement out of the rest position.

3. The printing device according to claim 1, wherein the slide cover comprises its own printing-head cover insert, which is preferably made of a softer material than the remaining slide cover.

4. The printing device according to claim 3, wherein the cover insert has the shape of a flat cap.

5. The printing device according to claim 1, wherein the cover comprises a separate wiper lip insert for wiping the printing head during the displacement of the slide cover into the printing position.

6. The printing device according to claim 5, wherein the wiper lip insert during the displacement of the slide cover is deflectable out of a vertical rest position by abutment on the printing head.

7. The printing device according to claim 6, wherein the wiper lip insert comprises an exemption on its freely cantilevering upper side, i.e. on the front edge facing away from the printing position, and wherein a printing part of the printing head remains uncleaned during the displacement of the slide cover into the rest position in order to avoid drying-up.

8. The printing device according to claim 5, wherein the wiper lip insert is made of the same material as a printing-head cover insert.

9. The printing device according to claim 1, wherein the slide cover activates a printing-head switch-on device in the printing position.

10. The printing device according to claim 1, wherein the slide cover comprises throughgoing openings for the passage of radiation of position sensors, e.g. laser sensors.

11. The printing device according to claim 1, wherein the slide cover comprises cover tabs covering position sensors, e.g. laser sensors, in its rest position.

* * * * *